US005460190A

United States Patent [19]

Bondick

[11] Patent Number: 5,460,190

[45] Date of Patent: Oct. 24, 1995

[54] CLAMPING HAIR CURLER

[76] Inventor: Connie M. Bondick, 12425 E. Glenhaven Dr., Baton Rogue, La. 70815

[21] Appl. No.: 247,324

[22] Filed: May 23, 1994

[51] Int. Cl.[6] ..... A45D 2/20

[52] U.S. Cl. ..... 132/247; 132/233

[58] Field of Search ..... 132/245, 246, 132/247, 250, 226, 233, 228, 234, 276, 277, 278; 24/265 EC, 484, 16 R, 510

[56] References Cited

U.S. PATENT DOCUMENTS

| | | | |
|---|---|---|---|
| 3,631,868 | 1/1972 | Solomon | 132/245 |
| 3,653,391 | 4/1972 | Andrews | 132/245 |
| 3,705,974 | 12/1972 | Nilsson | 219/222 |
| 3,848,610 | 11/1974 | Thomas | 132/39 |
| 3,858,029 | 12/1974 | Walter | 219/222 |
| 4,572,221 | 2/1986 | Barradas | 132/246 |

*Primary Examiner*—John G. Weiss
*Assistant Examiner*—Elise P. Speaks
*Attorney, Agent, or Firm*—Kenneth S. Watkins, Jr.

[57] ABSTRACT

A hair curler is disclosed which comprises a pretensioned helical spring covered by a foam rubber sleeve. A clamp is attached to one end of the curler which allows the hair to be curled around the body of the curler and the curler bent in a ring shape and retained in this shape by fixing the clamp to the curler body. The curler is heated by inserting a heating element in the center core of the curler. An alternative embodiment comprises a helical spring embedded in a hollow cylinder of a flexible material. The cylinder has a foam rubber sleeve and a clamp fixed to one end.

3 Claims, 3 Drawing Sheets

CLAMPING HAIR CURLER

BACKGROUND

Individuals using various hair curling methods are well aware of their drawbacks, especially when users install their own curiers. The curiers are hot, causing discomfort to the hands and even burning of the hair or scalp, especially in externally heated curiers. Clamping the hair to the curiers and retaining the curler in the desired position is often difficult, especially if the roller surface is slippery or if the clamping mechanism for the curler is complicated or cumbersome.

Many curler designs have been disclosed to address these difficulties. Some designs employ rigid plastic curiers with combing spikes to aid in curling and holding the hair. Most of these designs employ separate clips to retain the curiers in place once they have been set. These designs suffer the drawback of having to locate separate parts during use as well as having to store the clips.

Another popular design employs a flexible body of smooth plastic which can be wrapped into a ring and one end inserted into a hole on the other side. This design lacks rigidity making it difficult to roll the hair onto the body. It also suffers the drawbacks of limited adjustment range and difficulty inserting the end in the hole, especially when users are curling their own hair. This design is also externally heated, resulting in the wrapping surface being the hottest surface which increases the discomfort of applying the curiers and may scorch the hair or burn the scalp.

An object of this invention is to provide a curler which is rigid enough to curl the hair easily, yet can be wrapped into a ring shape to clamp the hair and curler in place.

Another object of the present invention is to provide an integral means to clamp a large or small amount of hair to provide for differences in hair styles, hair length and hair thickness.

Another object of the invention is to provide a highly resilient curling surface to improve grip and ease the curling operation.

Another object of this invention is to provide a hair curler which can be used with a steaming, moisturizing or conditioning heating unit.

Yet another object of the present invention is to provide a means for internal heating of the curler to limit the curling surface temperature, improving the comfort to the user and reducing the possibility of burning the hair.

SUMMARY

My invention addresses the limitations of previous designs. It comprises a semi-rigid body formed by a helical spring. The spring is pretensioned, having closely wound coils so that, in a relaxed state, adjacent coils contact each other biasing the spring in a straight bar shape. A resilient sleeve surrounds the helical spring to increase the adhesion of hair curled around the sleeve of the curler and to improve the grip of the fingers on the curler. A clamp which clamps the body of the curler is attached to one end of the curlet body. Hair is wrapped around the sleeve of the curler with the body of the curler in the relaxed (straight) position. The hair and curler are set by clamping the end of the curler to the body, forming a ring shape and securely clamping the hair.

The preferred embodiment of the device utilizes a jaw clamp which is biased in the closed position. The fixed jaw of the clamp is attached to the end of the helical spring.

An alternative embodiment of the present invention utilizes a helical spring embedded in a hollow cylinder. The cylinder is made of a flexible material which provides thermal storage. An absorbent foam sleeve surrounds the cylinder and improves comfort and curling convenience.

BRIEF DESCRIPTION OF THE DRAWINGS

These and other features, aspects, and advantages of the present invention will become better understood with regard to the following description, appended claims, and accompanying drawings where:

DETAILED DESCRIPTION

The hair curling device disclosed retains the straight shape of the curler to simplify hair curling, yet allows forming a closed ring shape to clamp the hair to the curler.

Figure 1:
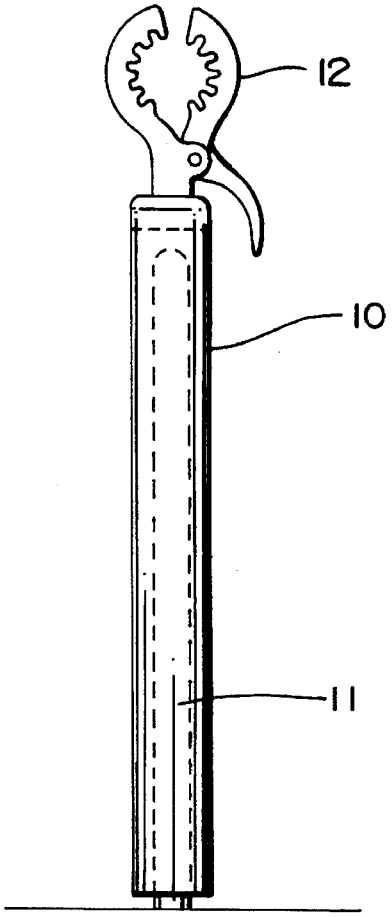
FIG. 1 is an elevation drawing of the preferred embodiment of the present invention.
Figure 2:
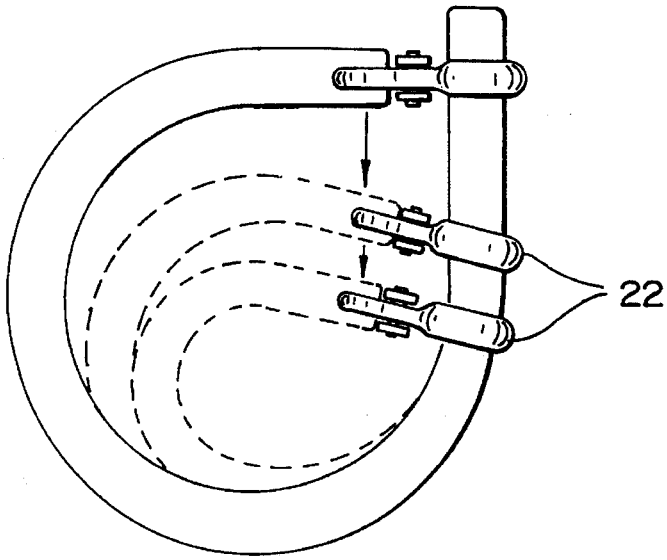
FIG. 2 is a top view of the present invention clamped in a ring shape.

FIG. 1 is an elevation drawing of the present invention. Curler body 10 is a flexible, heat-retaining member containing a hollow core 11. A heating element (not shown) inside the core heats the curler body to the desired temperature. Clamp 12 clamps one end of the body to a point along the body and results in a closed ring shape as shown in FIG. 2.

Hair is wrapped or rolled onto the curler when the curler is in the straight position as shown in FIG. 1. Curling is simplified by the straight bar-shape bias of the curler and the use of a resilient cover described in the following figures. Clamp 12 is then clamped to body 10 in a position such as position 22 of FIG. 2 so the hair is clamped by the closed ring shape of the body. The many possible positions of clamp 12 allow various amounts of hair to be clamped by the device. The flexibility in the amount of hair that can be clamped allows the device to be used for a great variety of hair styles as well as a variety of hair length and thickness.

Figure 3:
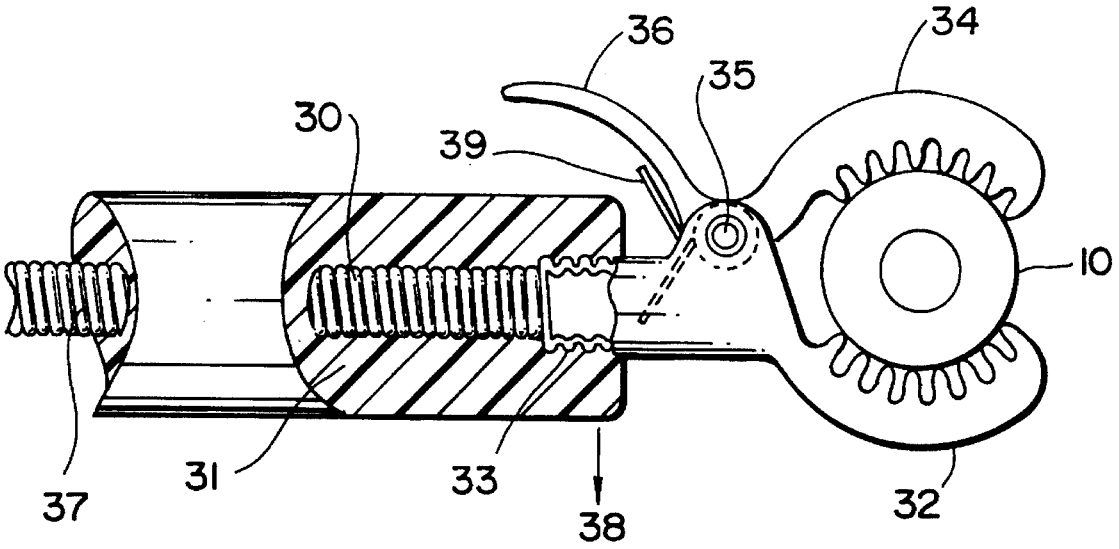
FIG. 3 is a partial fragmentary view of the clamp end of the preferred embodiment.

FIG. 3 is a fragmentary detail of body 10. A helical coil spring 30 provides the shape of the body. The spring is pretensioned so that coils 37 are in contact with each other when the spring is in a relaxed state. An external bending force 38 is required to separate the coils 37 of spring 30. The pretensioning of spring 30 results in a strong straight bar shape bias of the spring. The amount of pretension may be selected to determine the amount of bending force which is required to deflect spring 30.

The inner diameter of the spring, forming the hollow core of the device, is a sufficient diameter to allow insertion of a heating element. In the preferred embodiment, the spring material is steel to provide elasticity, thermal storage, durability and resistance to degradation of mechanical properties due to elevated temperature. Other metals or temperature-resistant plastics or composites may also be used.

A foam rubber or plastic sleeve 31 surrounds spring 30.

Sleeve 31 is retained by an interference fit with helical spring 30. Alternatively, sleeve 31 may be bonded to helical spring 30. The foam sleeve provides a highly resilient surface to improve the grip of the hair and fingers to the curler and facilitate wrapping of the hair around the curler. The resilient sleeve also provides insulation to provide comfort to the user when the curiers are heated.

Fixed jaw 32 is attached to one end of helical spring 30. Fixed jaw end 33 is crimped to one end of helical spring 30. Movable jaw 34 is supported and biased closed by jaw spring 39 at pin 35. Jaw spring 39 surrounds pin 35 with one end of the jaw spring against movable jaw handle 36 and the other end against stationary jaw 32. Jaw handle 36 is pressed to open movable jaw 34 against jaw spring 39 bias to allow insertion and removal of curler body 10. Upon release of jaw handle 36, body 10 is grasped by movable jaw 34 and stationary jaw 32.

Figure 4:
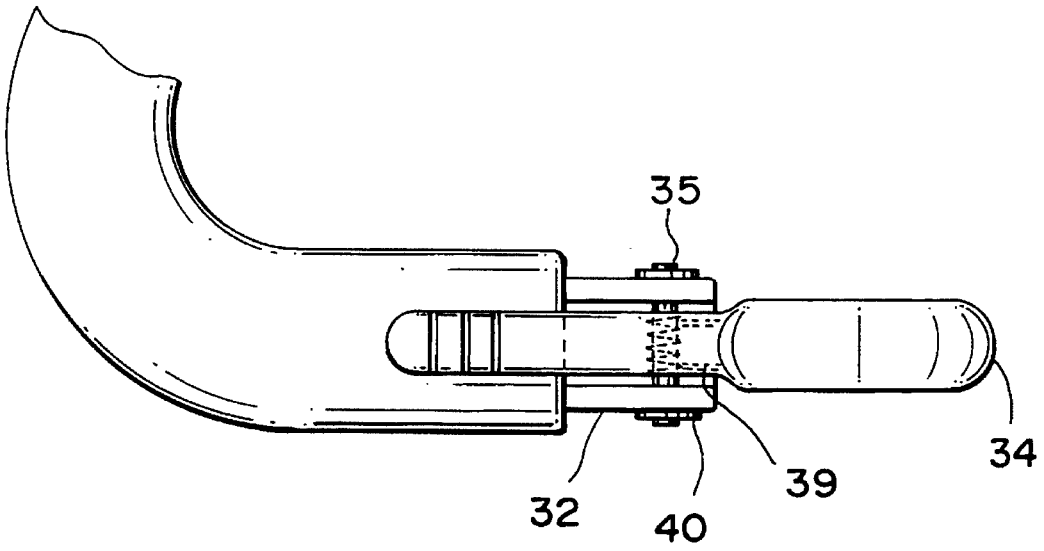
FIG. 4 is a top view of the clamp end.

FIG. 4 is a top view of FIG. 3 showing movable jaw 34 pivoted on stationary jaw 32 at pin 35. A pin retainer such as a spring clip 40 retains pin 35. Jaw spring 39 biases movable jaw 34 to the closed position.

Figure 5:
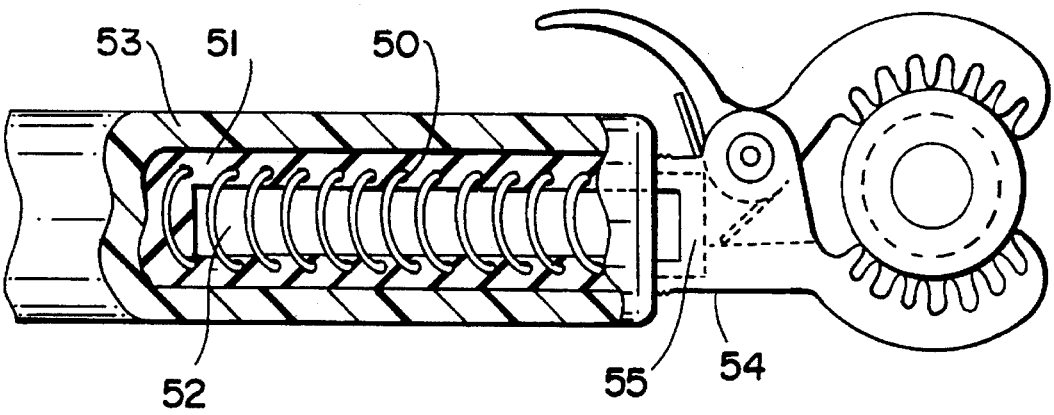
FIG. 5 is a partial fragmentary view of an alternative embodiment of the present invention.

FIG. 5 is shows an alternative embodiment of the present invention where helical spring 50 is embedded in a flexible hollow cylinder 51. The longitudinal axis of cylinder 51 is coaxial with the longitudinal axis of helical spring 50. Cylinder 51 is made from a plastic or rubber material such as Viton which exhibits good elasticity and is resistant to degradation of mechanical properties due to elevated temperature. Hollow core 52 allows insertion of a heating element (not shown). Foam sleeve 53 surrounds cylinder 51 and is retained by an interference fit between cylinder 51 and sleeve 53, or alternatively, sleeve 53 may be bonded to cylinder 51. Fixed jaw end 54 is crimped to cylinder end 55.

Figure 6:
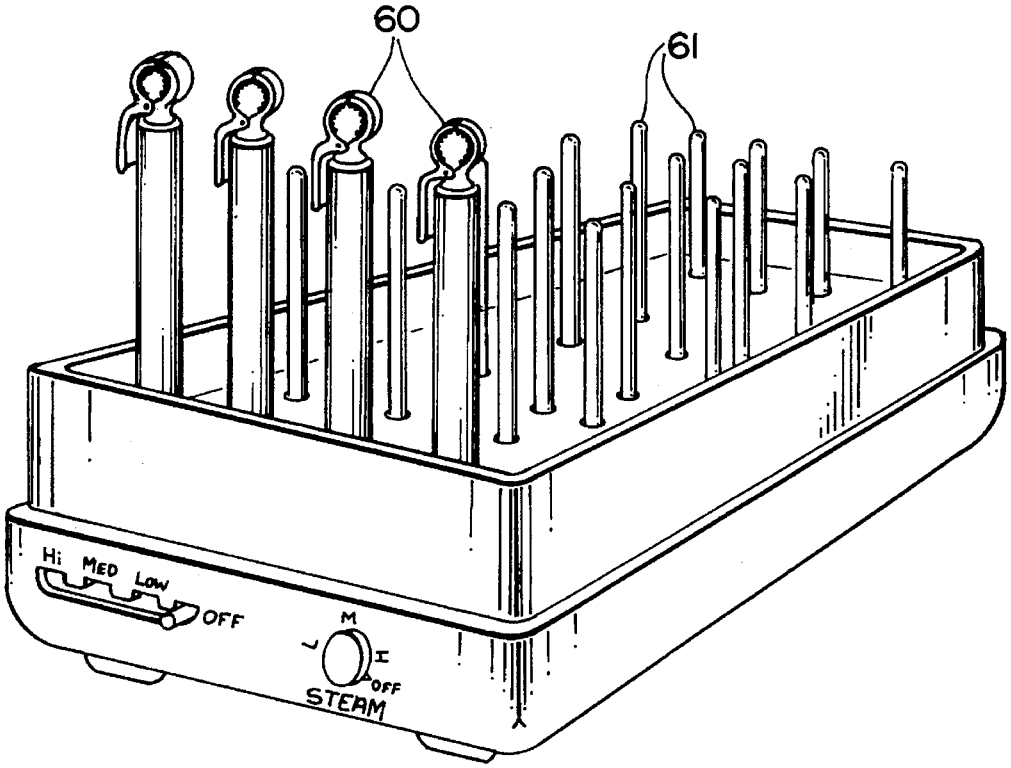
FIG. 6 is a perspective drawing of the present invention installed in a curler heater.

FIG. 6 shows clamping hair curiers 60 inserted onto heating elements 61. The use of internal heating of the curiers minimizes the external temperature of the curler for the thermal energy stored in the curler, minimizing the possibility of burning or scorching the hair. The use of foam sleeves allows a steaming or moisturizing bath type of curler heating device to further condition the hair as desired.

After heating, hair is wound around the curler body 10. In the preferred embodiment, curling is simplified by the straight bar shaped bias of the pretensioned helical spring 30 and resilient sleeve 31 which improves grip and comfort. The curler body is then bent into a ring shape by pressing movable jaw clamp handle 36 and positioning clamp 12 to a position which clamps the hair securely. Handle 36 is then released to secure clamp 12 to body 10. The curiers may be removed by reversing the installation procedure.

The foam sleeve 31 allows the curler to be used in a steaming or moisturizing heater. Moisture and conditioning agents, if used, will be absorbed by the foam sleeve and then wicked to the hair after installation.

Accordingly the reader will see the clamping hair curler allows the curling and clamping of a wide range of hair lengths and thicknesses. The device comprises the following additional advantages:

its rigidity in the straight position allows easy rolling of the hair;

the use of a foam sleeve improves adhesion, comfort, and allows use of moisturizing methods such as steaming of the curiers;

no separate clips are required to clamp the hair to the curler; and it is simple and can be manufactured at low cost,.

Although the description above contains many specifications, these should not be construed as limiting the scope of the invention but as merely providing illustrations of some of the presently preferred embodiments of this invention. For example, the helical spring coils could be oval or rectangular in shape so that bending of the curler is easier in some directions than others, etc.

Thus the scope of the invention should be determined by the appended claims and their legal equivalents, rather than by the examples given.

I claim:

1. A hair-curler device for clamping hair comprising:

(a) a cylinder of flexible, heat-retaining material having a hollow, central core;

(b) a helical coiled spring embedded in the wall of the cylinder so that the longitudinal axis of the cylinder is coaxial to the longitudinal axis of the coiled spring;

(c) an absorbent foam layer on the outside surface of the cylinder; and (d) a clamp attached to one end of the cylinder.

2. The device as in claim 1 wherein the clamp is a jaw clamp further comprising a fixed jaw and a movable jaw, the movable jaw being biased in the closed position and the fixed jaw being attached to one end of the flexible cylinder.

3. A hair-curler device for clamping hair, the device comprising:

(a) a curler body comprising a pretensioned helical spring, the helical spring comprising a central core for inserting a heating element, and a resilient sleeve surrounding the helical spring; and (b) a jaw clamp for clamping the curler body, the jaw clamp attached to one end of the curler body whereby the curler body may be fashioned into a continuous ring shape by clamping the curler body with the jaw clamp and wherein the jaw clamp comprises a fixed jaw and a movable jaw, the movable jaw being biased in the closed position and the fixed jaw being attached to one end of the helical spring.

* * * * *